US007026381B2

(12) United States Patent
Fujisawa et al.

(10) Patent No.: US 7,026,381 B2
(45) Date of Patent: Apr. 11, 2006

(54) ONE-PIECE GOLF BALL

(75) Inventors: Koichi Fujisawa, Kobe (JP); Kazuhiko Isogawa, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 93 days.

(21) Appl. No.: 10/849,231

(22) Filed: May 20, 2004

(65) Prior Publication Data

US 2004/0235588 A1 Nov. 25, 2004

(30) Foreign Application Priority Data

May 23, 2003 (JP) ..... 2003-146493

(51) Int. Cl.
*A63B 37/06* (2006.01)
*A63B 37/12* (2006.01)
*A63B 37/14* (2006.01)

(52) U.S. Cl. ..... 524/120; 524/128; 524/147; 524/151; 525/274; 473/371

(58) Field of Classification Search ..... None
See application file for complete search history.

(56) References Cited

U.S. PATENT DOCUMENTS 4,065,537 A * 12/1977 Miller et al. ..... 264/143
6,716,116 B1 4/2004 Yokota
2002/0098919 A1* 7/2002 Fushihara et al. ..... 473/378

FOREIGN PATENT DOCUMENTS

JP 7-51403 A 2/1995
JP 2001-212262 A 8/2001

* cited by examiner

*Primary Examiner*—David J. Buttner
(74) *Attorney, Agent, or Firm*—Birch, Stewart, Kolasch & Birch, LLP

(57) ABSTRACT

The object of the present invention is to provide a one-piece golf ball having an improved repulsion and coloring-resistance, and showing a good adhesion to the paint film. The one-piece golf ball of the present invention comprises a golf ball body formed by vulcanizing a rubber composition and a paint film covering the golf ball body, wherein the rubber composition contains 0.05 to 10 parts by mass of a phosphorus stabilizer with respect to 100 parts by mass of the rubber component.

10 Claims, No Drawings

ONE-PIECE GOLF BALL

This Non-provisional application claims priority under 35 U.S.C. §119(a) on Patent Application No(s). 2003-146493 filed in Japan on May 23, 2003, the entire contents of which are hereby incorporated by reference.

BACKGROUND OF THE INVENTION

1. Field of the Invention

The present invention relates to a one-piece golf ball, more particularly to a one-piece golf ball having a paint film formed on the surface of the golf ball body.

2. Description of the Related Art

Conventionally, the one-piece golf ball is used as a golf ball in a golf driving range. If the one-piece golf ball is used in the golf driving range for a long term, the one-piece golf ball changes in color because of being exposed to the sun-light and the elements. Also, the paint film formed on the golf ball body occasionally peels off, because the one-piece golf ball is used while being repeatedly hit and washed. The coloring and the peeling of the paint film should be avoided, because they will give an impression that the golf ball is deteriorated. Especially, in the case that the paint film peels off, the golf ball body is directly exposed to the sun-light and the elements, the golf ball body is actually deteriorated, thus the performance of the golf ball is lowered. Further, it is required in a higher degree to enhance the repulsion of the one-piece golf ball body, thereby improving the flying performance of the one-piece golf ball, because the one-piece golf ball has lower flying performance, compared with the two-piece golf ball and the wound core golf ball.

Under these circumstances, various one-piece golf balls have been proposed. For example, Japanese unexamined patent publication No. 2001-212262 discloses the golf ball where the adhesion of the paint film is improved by formulating a silane-coupling agent into the golf ball body. In addition, Japanese unexamined patent publication Nos. H07-51403 and 2001-17576 disclose the golf ball where the blue pigment is blended in the golf ball body, and the anti-oxidant, the light-stabilizer and the fluorescent brightener or the like are formulated in the clear paint film, thereby improving the adhesion of the paint film as well as imparting the bright whiteness to the golf ball.

SUMMARY OF THE INVENTION

According to the methods disclosed in the above Japanese unexamined patent publications, it is impossible to enhance the repulsion of the golf ball, thereby improving the flying performance, although the coloring and the adhesion of the paint film may be improved. Further, the golf ball disclosed in Japanese unexamined patent publication No. H07-51403 occasionally changes in color with time. This is attributed to the fact that the hindered phenol type antioxidant used changes into the compound which develops yellow or red color.

The present invention has been achieved in view of the above problems. The object of the present invention is to provide a one-piece golf ball which has an excellent adhesion to the paint film and the weather-resistance (especially, the coloring-resistance) in addition to an improved repulsion.

The present invention provides a one-piece golf ball comprising a golf ball body formed by vulcanizing a rubber composition and a paint film covering the golf ball body, wherein the rubber composition contains 0.05 to 10 parts by mass of a phosphorus stabilizer with respect to 100 parts by mass of the rubber component. The present invention has been achieved on the finding that formulating the phosphorus stabilizer in the rubber composition constituting the golf ball body prevents the coloring of the golf ball, concurrently improves the repulsion of the golf ball, and further improves the adhesion to the paint film.

DESCRIPTION OF THE PREFERRED EMBODIMENT

The golf ball of the present invention comprises a golf ball body formed by vulcanizing a rubber composition and a paint film covering the golf ball body, wherein the rubber composition contains 0.05 to 10 parts by mass of a phosphorus stabilizer with respect to 100 parts by mass of the rubber component.

The rubber composition has no limitation on its composition, as long as the rubber composition contains 0.05 to 10 parts by mass of the phosphorus stabilizer with respect to 100 parts by mass of the rubber component. In a preferable embodiment, the rubber composition can include, for example, the rubber component, the phosphorus stabilizer, an α,β-unsaturated carboxylic acid and/or a metal salt thereof, an organic peroxide, a pigment, and a filler or the like, as long as 0.05 to 10 parts by mass of the phosphorus stabilizer is contained with respect to 100 parts by mass of the rubber component.

The rubber component contained in the rubber composition includes, but is not limited to, butadiene rubber (BR), ethylene-propylene-diene terpolymer (EPDM), isoprene rubber (IR), isobutylene-isoprene rubber (IIR), natural rubber (NR), acrylonitrile butadiene rubber (NBR), and styrene butadiene rubber (SBR). The above rubber components can be used individually or in combination of at least two of them. Among them, the rubber component preferably contains the butadiene rubber as a major component. More preferably, the rubber component contains 50% or more by mass of the butadiene rubber. Further, the butadiene rubber is preferably a high cis-polybutadiene in which the content of cis-1,4-bond is not less than 90%. An example of the high cis-polybutadiene rubber is BR-11 available from JSR.

The α,β-unsaturated carboxylic acid and/or a metal salt thereof is used as a co-crosslinking agent. The α,β-unsaturated carboxylic acid and/or the metal salt thereof is contained in the rubber composition in an amount of preferably not less than 15 parts by mass, more preferably not less than 18 parts by mass, and preferably not more than 40 parts by mass, more preferably not more than 38 parts by mass. If the amount of the unsaturated carboxylic acid and/or the metal salt thereof is less than 15 parts by mass, the resulting golf ball body becomes excessively soft and largely deforms when hit, thus the adhesion to the clear paint film will be lowered. In contrast, an amount of the unsaturated carboxylic acid exceeding 40 parts by mass invites an excessively hard shot feeling.

The α,β-unsaturated carboxylic acid and/or the metal salt thereof includes, for example, without limitation, an α,β-unsaturated carboxylic acid and/or a metal salt thereof each having 3 to 8 carbon atoms such as acrylic acid, methacrylic acid, zinc acrylate, zinc methacrylate. Especially, in a preferable embodiment, zinc salt or magnesium salt is used as the metal salt to enhance the repulsion of the golf ball.

The organic peroxide is formulated to vulcanize the rubber component. The amount of the organic peroxide is preferably not less than 0.3 part by mass, more preferably not less than 0.5 part by mass, and preferably not more than 5 parts by mass, and more preferably not more than 3 parts by mass, with respect to 100 parts by mass of the rubber component. Illustrative organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. Dicumyl peroxide is typically preferred.

The pigment which may be contained in the rubber composition includes, for example, a white pigment, a blue pigment, and a violet pigment. Titanium oxide is preferably used as the white pigment. The type of the titanium oxide is not critical but rutile titanium oxide is advantageously employed for its high opacifying properties. The amount of the titanium oxide is preferably not less than 0.5 part by mass, more preferably not less than 1 part by mass, and preferably not more than 5 parts by mass, more preferably not more than 2 parts by mass, with respect to 100 parts by mass of the rubber component.

In a preferable embodiment, the rubber composition contains the white pigment and the blue pigment. The blue pigment is formulated to impart the bright whiteness to the golf ball. Examples of the blue pigment are, but are not limited to, ultramarine blue pigment, cobalt blue pigment, and copper phthalocyanine blue pigment. The amount of the blue pigment is preferably not less than 0.001 part by mass, more preferably not less than 0.05 part by mass, and preferably not more than 0.2 part by mass, more preferably not more than 0.1 part by mass, with respect to 100 parts by mass of the rubber component. If the amount of the blue pigment is less than 0.001 part by mass, the resulting golf ball is insufficiently blue-colored and has a yellowish color. In contrast, if the amount of the blue pigment exceeds 0.2 part by mass, the resulting golf ball is excessively blue-colored and cannot significantly have a brightly white appearance.

Examples of the violet pigment are, but are not limited to, anthraquinone violet pigment, dioxazine violet pigment, and methyl violet pigment.

The filler, which can be contained in the rubber composition, is used to adjust the gravity of the rubber composition. The amount of the filler is preferably not less than 15 parts by mass, more preferably not less than 20 parts by mass, and preferably not more than 40 parts by mass, more preferably not more than 30 parts by mass with respect to 100 parts by mass of the rubber component. Examples of the filler are zinc oxide, silica, calcium carbonate, and barium sulfate. Preferably used is zinc oxide or barium sulfate.

Next, the phosphorus stabilizer used in the present invention will be explained. The phosphorus stabilizer used in the present invention includes a stabilizer derived from an oxo-acid of phosphorus. The phosphorus stabilizer does not only improve the adhesion of the paint film but also enhances the repulsion of the golf ball and prevents the coloring of the golf ball. The phosphorus stabilizer works effectively for satisfying the three requirements such as the coloring-resistance, the repulsion, and the adhesion to the paint film at the same time, thus leading to the cost reduction. From this aspect, the phosphorus stabilizer is contained in the rubber composition in an amount of not less than 0.05 part by mass, preferably not less than 0.06 part by mass, more preferably not less than 0.2 part by mass, and not more than 10 parts by mass, preferably not more than 8.5 parts by mass, more preferably not more than 5 parts by mass, with respect to 100 parts by mass of the rubber component. If the amount of the phosphorus stabilizer is less than 0.05 part by mass, the improvement of the coloring-resistance, the adhesion and the repulsion imparted by the phosphorus stabilizer is not sufficient, while if the amount is more than 10 parts by mass, the adhesion to the paint film will be lowered remarkably, although the coloring resistance and the repulsion are improved.

Examples of the phosphorus stabilizer used in the present invention are, but are not limited to, a hypophosphorous acid compound (phosphinic acid compound), a phosphorous acid compound (phosphonic acid) or a derivative thereof.

The hypophosphorous acid compound includes, for example, a hypophosphite (ester of hypophosphorous acid compound) and a derivative thereof. Examples of the hypophosphite and a derivative thereof are tetrakis (2,4-di-tert-butylphenyl)[1,1-biphenyl]-4,4'-diylbisphosphonite, tetrakis (2,4-di-tert-butyl-5-methylphenyl)[1,1-biphenyl]-4, 4'-diylbisphosphonite.

The phosphorous acid compound includes a phosphite having at least one functional group selected from the group consisting of alkyl group, phenyl group, and alkylphenyl group; and a derivative thereof (phosphonate and a derivative thereof), for example, tris (alkylphenyl)phosphite, tris (alkyl)phosphite, and pentaerythritol phosphite derivative.

Examples of the phosphite and the derivative thereof are the tris(alkylphenyl)phosphite such as tris(nonylphenyl) phosphite, tris(2,4-di-tert-butylphenyl)phosphite; the pentaerythritol phosphite derivative such as di(tridecyl)pentaerythritol diphosphite, di(nonylphenyl)pentaerythritol diphosphite, di(isodecyl)pentaerythritol diphosphite, di(stearyl)pentaerythritol diphosphite, di(2,4-di-tert-butylphenyl)pentaerythritol diphosphite, di(2,6-di-tert-butyl-4-methylphenyl)pentaerythritol diphosphite, hydrogenated bisphenol A pentaerythritol phosphite polymer, tetraphenyltetra(tridecyl)pentaerythritol tetraphosphite; other phosphites such as phenyldi(isodecyl)phosphite, cyclic neopentane tetrayl(octadecylphosphite), 2,2'-methylenebis(4,6-di-tert-butylphenyl)octylphosphite; hydrogenated bisphenol A phosphate polymer, tetra(tridecyl)-4,4'-isopropylydenediphenyl diphosphite, tetraphenyldipropyleneglycol diphosphite.

Among the above phosphorus stabilizers, the following compounds are preferable. tetrakis(2,4-di-tert-butylphenyl)[1,1-biphenyl]-4,4'-diylbisphosphonite represented by formula 1; tetrakis(2,4-di-tert-butyl-5-methylphenyl)[1,1-biphenyl]-4,4'-diylbisphosphonite represented by formula 2; tris(2,4-di-tert-butylphenyl)phosphite represented by formula 3; di(stearyl)pentaerythritol diphosphite represented by formula 4; di(2,4-di-tert-butylphenyl)pentaerythritol diphosphite represented by formula 5; di(2,6-di-tert-butyl-4-methylphenyl)pentaerythritol diphosphite represented by formula 6; and 2,2'-methylenebis(4,6-di-tert-butylphenyl) octylphosphite represented by formula 7. These phosphorus stabilizers improve the repulsion, the coloring-resistance and the adhesion to the paint film.

(1)
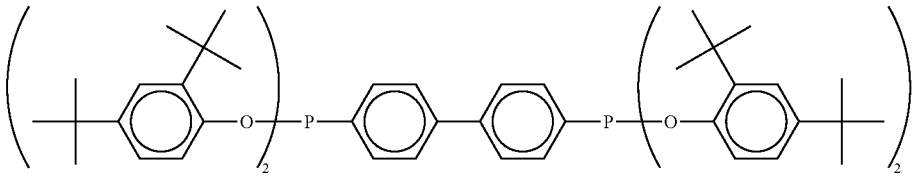
Formula 1
(2)
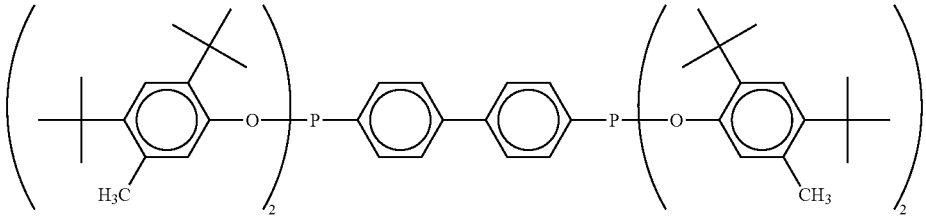
Formula 2
(3)
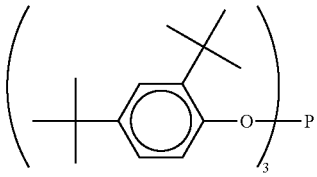
Formula 3
(4)
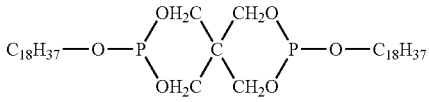
Formula 4
(5)
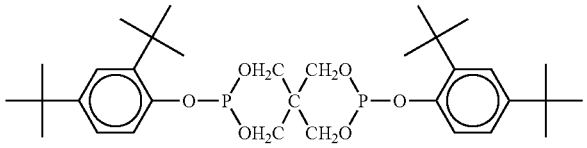
Formula 5
(6)
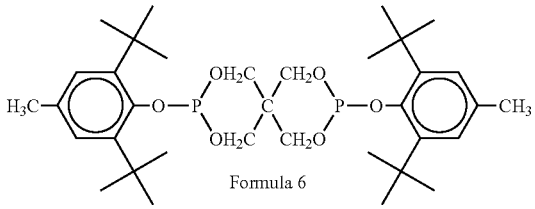
Formula 6
(7)
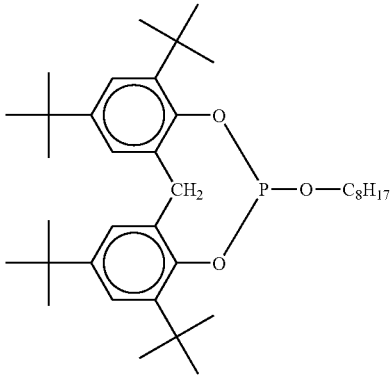
Formula 7

The rubber composition used in the present invention may further include an antioxidant and a softening agent, in addition to the phosphorus stabilizer.

The golf ball body of the inventive golf ball is formed by vulcanizing the rubber composition described above. The condition for vulcanizing the rubber composition can be appropriately determined on the rubber composition. The vulcanization of the rubber composition is conventionally conducted at the temperature of 130 to 200° C. for 10 to 60 minutes. Alternatively, the vulcanization is preferably carried out in a two-step heating, for example, at the temperature of 130 to 150° C. for 20 to 40 minutes, and continuously at the temperature of 160 to 180° C. for 5 to 15 minutes.

Conventionally, the golf ball body is formed with a multiplicity of concavities, which is so called "dimple", at the surface thereof. As required, the surface of the golf ball body can be subjected to grinding treatment such as sandblast in order to enhance the adhesion of the paint film.

In a preferable embodiment, the one-piece golf ball of the present invention comprises a paint film covering the golf ball body which is formed by vulcanizing the above rubber composition, wherein the paint film contains the above phosphorus stabilizer. Formulating the phosphorus stabilizer into both the golf ball body and the paint film covering the golf ball body further improves the adhesion of the paint film. Preferably, the paint film contains the resin component and the phosphorus stabilizer described above, and the phosphorus stabilizer is contained in an amount of preferably not less than 0.05 part by mass, more preferably not less than 0.1 part by mass, and preferably not more than 5 parts by mass, more preferably not more than 4 parts by mass with respect to 100 parts by mass of the resin component. If the amount of the phosphorus stabilizer is less than 0.05 part by mass, the effect of the phosphorus stabilizer contained in the paint film tends to be lowered, while if the amount of the phosphorus stabilizer is more than 5 parts by mass, the adhesion of the paint film will be lowered.

As the phosphorus stabilizer formulated in the paint film, the phosphorus stabilizer formulated in the above rubber composition can be used. However, the phosphorus stabilizer used for the paint film is not necessarily the same phosphorus stabilizer used for the rubber composition. The different phosphorus stabilizer can be selected for the rubber composition and for the paint film, respectively from the above list of the phosphorus stabilizers.

The resin component contained in the paint film covering the golf ball body is not restricted, and includes a conventional component used for the golf ball paint film, for example, the acrylic resin, the epoxy resin, the urethane resin, the polyester type resin, and the cellulose type resin. Among them, the two-component curing type urethane resin as described later is preferable. In general, the use of the two-component curing type urethane resin provides the paint film with an excellent durability and abrasion resistance.

The two-component curing type urethane resin is a urethane resin obtainable by the curing reaction between the base material and the curing agent. For example, the urethane resin is obtained by curing the base material containing an isocyanate-group terminated urethane prepolymer with the curing agent having an active hydrogen, or curing the base material containing the polyol component with the polyisocyanate or a derivative thereof.

In the present invention, typically preferred as the resin component of the paint film is the two-component curing type urethane resin which is obtainable by curing the base material containing the polyol component with the curing agent such as the polyisocyanate or a derivative thereof.

As the base material containing the polyol component, the following specific urethane polyol is preferable. The urethane polyol includes any polyol having a urethane bond and at least two hydroxyl groups (preferably at the terminal thereof). The urethane polyol is, for example, obtained by reacting a polyol with a polyisocyanate in such a molar ratio that the hydroxyl group of the polyol component is excess to the isocyanate group of the polyisocyanate.

The polyisocyanate for producing the urethane polyol is not limited, as long as it has at least two isocyanate groups. Examples of the polyisocyanate are an aromatic polyisocyanate such as 2,4-tolylene diisocyanate, 2,6-tolylene diisocyanate, a mixture (TDI) of 2,4-tolylene diisocyanate and 2,6-tolylene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylenediisocyanate(TMXDI) and paraphenylene diisocyanate (PPDI); and an alicyclic or aliphatic polyisocyanate such as 4,4'-dicyclohexylmethane diisocyanate (hydrogenated MDI), hydrogenated xylylenediisocyanate($H_6$XDI) hexamethylene diisocyanate (HDI), and isophorone diisocyanate (IPDI). The polyisocyanate can be used either alone or in combination of two or more. Among them, non-yellowing type polyisocyanate (TMXDI, XDI, HDI, $H_6$XDI, IPDI, $H_{12}$MDI) are preferable in view of weather resistance. In addition, the above polyisocyanate can be used as a curing agent for curing the urethane polyol.

The polyol for producing the urethane polyol is not limited, as long as it has a plurality of hydroxyl groups. The polyol includes, for example, a low-molecular weight of polyol and a high-molecular weight of polyol. Examples of the low-molecular weight of polyol are a diol such as ethylene glycol, diethylene glycol, triethylene glycol, 1,3-butanediol, 1,4-butanediol, neopentyl glycol, 1,6-hexane glycol; or a triol such as glycerin, trimethylol propane, and hexanetriol. Examples of the high-molecular weight of polyol are a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ϵ-caprolactone (PCL); a polycarbonate polyol such as polyhexamethylene carbonate; and an acrylic polyol. Among them, preferably used is the polyol having a weight average molecular weight of not less than 50, more preferably not less than about 100, and having a weight average molecular weight of not more than 2000, more preferably not more than about 1000. The above polyol can be used individually or in combination of at least two of them.

Preferably, the urethane polyol has urethane bonds in a ratio of 0.1 to 5 mmol with respect to 1 gram of the urethane polyol. The ratio of urethane bond affects the stiffness of the resulting paint film. If the ratio of urethane bonds is less than 0.1 mmol/g, the concentration of the urethane bond in the paint film becomes too low to provide a sufficient scuff resistance. If the ratio of urethane bonds is greater than 5 mmol/g, the paint film has excessively high hardness. Such a hard paint film does not follow the deformation of the golf ball body, resulting in crack of the paint film.

The urethane polyol preferably has a weight average molecular weight of 4000 or more, more preferably a weight average molecular weight of 4500 or more, and preferably has a weight average molecular weight below 10000, more preferably a weight average molecular weight of 9000 or less. When the molecular weight of the urethane polyol is less than 4000, drying process requires a longer time. As a result, coating workability and productivity of golf balls tend to become low. While if the molecular weight of the urethane polyol is 10000 or greater, the hydroxyl value of the urethane polyol becomes relatively small. Thus, the reaction ratio between the paint film and the surface of the golf ball becomes low. Consequently, the adhesion of the paint film to the surface of the golf ball tends to be low. Further, the use of urethane polyol having a weight average molecular weight of 9000 or less allows the paint film to form a dense layer which does not lower the adhesion even in a wet condition.

The urethane polyol preferably has a hydroxyl value of not less than 15 mgKOH/g, more preferably not less than 73 mgKOH/g, and preferably has a hydroxyl value of not more than 130 mgKOH/g, more preferably not more than 120 mgKOH/g. If the hydroxyl value is less than 15 mgKOH/g, the reaction between the urethane polyol and the curing agent tends to be insufficient. The insufficient reaction causes the lower adhesion of the paint film to the golf ball body. On the other hand, if the hydroxyl value is more than 130 mgKOH/g, the reaction with the curing agent tends to require longer time, resulting in longer drying time and lower productivity.

The above urethane polyol is obtainable by reacting the polyisocyanate and the polyol. In the reaction for producing the urethane polyol, a solvent or a catalyst (for example, dibutyl tin dilaurate), which are well-known for producing polyurethane, may be used. The ratio of the urethane bond can be controlled by adjusting the blending ratio between the polyisocyanate and the polyol, or by selecting the molecular weight of the polyol as a raw material.

In one preferable embodiment, the polyol constituting the base material is the above urethane polyol itself, namely, the base material is substantially the above urethane polyol. In another preferable embodiment, the polyol, which is compatible with the above urethane polyol and has no urethane bond, may be contained in the base material, in addition to the urethane polyol. In this case, the polyol having no urethane bond includes, without limitation, the above polyol which is described as a raw material for producing the urethane polyol. In the case that the polyol having no urethane bond is contained in the base material, the amount of the urethane polyol contained in the base material is preferably not less than 50 mass %, more preferably not less than 80 mass %. If the amount of the urethane polyol contained in the base material is less than 50 mass %, the content of the urethane polyol becomes relatively small. Thus, the drying time tends to be longer.

The paint film of the invented golf ball may further contain a conventional additive such as an UV absorber, an antioxidant, a light stabilizer, a fluorescent brightener, an anti-blocking agent, and a pigment, in addition to the above resin component and the phosphorus stabilizer. In a preferable embodiment, the paint film is a clear paint film which does not contain a pigment substantially.

The paint film can be formed on the surface of the golf ball body by coating and drying the paint composition containing the above resin component and the phosphorus stabilizer, if necessary a solvent and the above additives, on the surface of the golf ball body. The paint film may have a single layered structure or a multi-layered structure. Preferably, the paint film has a single layered structure. Since the paint film is excellent in the adhesion to the golf ball in the present invention, the paint film performs sufficiently enough, even if the paint film has a single layered structure. The paint film has, without limitation, the preferable thickness of 5 to 20 μm. If the thickness is less than 5 μm, the paint film performs insufficiently, while if the thickness is more than 20 μm, the flying performance may be lowered due to the change in the depth of the dimples.

EXAMPLES

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

(1) Evaluation Method (1-1) Coloring-Resistance

The golf balls were subjected to the outdoor exposure test for 6 months. The change in the color of the paint film was visually observed.

Criteria:

E (Excellent): Change in color was hardly observed.

G (Good): Change in color was slightly observed.

P (Poor): Change in color was observed.

(1-2) Adhesion of the Paint Film Against the Impact of the Shot

Each golf ball was hit 150 times repeatedly with an iron (#5) attached to a swing robot manufactured by TRUETEMPER CO, at the head speed of 34 m/sec. The peeling condition of the paint film and the mark was visually observed, and evaluated based on the following criteria.

Criteria for the Paint Film:

E (Excellent): No peeling area of the paint film

G (Good): The peeling area of the paint film is not more than 5% with respect to the total area of the paint film.

F (Fair): The peeling area of the paint film is 5% (exclusive) to 20% with respect to the total area of the paint film.

P (Poor): The peeling area of the paint film is more than 20% with respect to the total area of the paint film.

Criteria for the Mark:

E (Excellent): No peeling area of the mark

G (Good): The peeling area of the mark is not more than 5% with respect to the total area of the mark.

F (Fair): The peeling area of the mark is 5% (exclusive) to 20% with respect to the total area of the mark.

P (Poor): The peeling area of the mark is more than 20% with respect to the total area of the mark.

(1-3) Adhesion of the Paint Film Against Brushing Wash

Each golf ball was subjected to brushing wash for 1 hour in the potato peeler having the inside surface covered with the brush. The peeling condition of the paint film and the mark was visually observed, and evaluated according to the following criteria.

Criteria for the Paint Film:

E (Excellent): No peeling area of the paint film

G (Good): The peeling area of the paint film is not more than 5% with respect to the total area of the paint film.

F (Fair): The peeling area of the paint film is 5% (exclusive) to 20% with respect to the total area of the paint film.

P (Poor): The peeling area of the paint film is more than 20% with respect to the total area of the paint film.

Criteria for the Mark:

E (Excellent): No peeling area of the mark

G (Good): The peeling area of the mark is not more than 5% with respect to the total area of the mark.

F (Fair): The peeling area of the mark is 5% (exclusive) to 20% with respect to the total area of the mark.

P (Poor): The peeling area of the mark is more than 20% with respect to the total area of the mark.

(1-4) Deformation Amount of the Golf Ball

The stress was measured when specific strain was given to each golf ball under the condition of 23° C. and 50% RH by using a ATTI compression tester produced by ATTI Engineering Co.

(1-5) Repulsion Coefficient of the Golf Ball

Each one-piece golf ball was struck with a 200 g aluminum cylinder at the speed of 45 m/sec. under the condition of 23° C. and 50% RH, the speed of the cylinder and the one-piece golf ball were respectively measured before and after being struck, and the repulsion coefficient of the each golf ball was calculated based on the speeds and weight of the cylinder and the golf balls. The measurement was carried out 5 times for each one-piece golf ball, and the average of 5 times was regarded as the repulsion coefficient of the one-piece golf ball.

(2) Production of the One-Piece Golf Ball Body

The rubber composition shown in Tables 1 to 3 was kneaded and vulcanizing-molded at 170° C. for 20 minutes to obtain the one-piece golf ball body having a diameter of 42.7 mm and a mass of 45.4 g. The following raw materials were used for the rubber composition shown in tables 1 to 3.

BR-11: Polybutadiene rubber(cis content: 96%) available from JSR Co.

Zinc oxide: "Ginrei R" produced by Toho-Zinc Co.

Dicumyl peroxide: "Percumyl D" produced by NOF corporation.

Phosphorus stabilizer: GSY-P 101 (tetrakis(2,4-di-tert-butyl-5-methylphenyl)[1,1-biphenyl]-4,4'-diylbisphsophonite) available from API corporation (3) Preparation of the Paint Composition (i) Base material: preparation of urethane polyol 60 parts by mass of PTMG250, 54 parts by mass of 550U were dissolved into 120 parts by mass of the solvent (toluene and methylethylketone). The dibutyl-tin-dilaurylate was added in an amount of 0.1 mass % with respect to the total base material. While keeping this polyol at 80° C., 66 parts by mass of isophorone diisocyanate was slow-added into the polyol to obtain a urethane polyol having a solid content of 60 mass %, hydroxyl value of 75 mgKOH/g, and a molecular weight of 7808.

(ii) Curing agent: Isophorone diisocyanate available from Sumitomo-Bayer Urethane Co., LTD.

(iii) Mixing ratio: NCO (curing agent)/OH (base material) =1.2 molar ratio (iv) The phosphorus stabilizer, a light-stabilizer, an UV-absorber, a fluorescent brightener described below were added into the above two-component curing type urethane paint to obtain the paint composition shown in Tables 1 to 3. The amounts of the phosphorus stabilizer, the light-stabilizer, the UV-absorber, the fluorescent brightener with respect to 100 parts by mass of the urethane resin were also shown in Table 1 to 3.

PTMG250: Polyoxytetramethyleneglycol having a molecular weight of 250 produced by BASF Co.

U550: branched polyol having a molecular weight of 550 produced by Sumitomo-Bayer Urethane Co.

Phosphorus stabilizer: GSY-P 101 (tetrakis(2,4-di-tert-butyl-5-methylphenyl)[1,1-biphenyl]-4,4'-diylbisphsophonite) available from API corporation:

Light stabilizer: Sanol LS770 available from Sankyo Lifetech Co., LTD.

UV-absorber: Tinuvin 900 available from Ciba-Geigy Limited

Fluorescent brightener: Ubitex OB available from Ciba-Geigy (4) Preparation of the Mark and the Paint Film The mark "X" having width of 8 mm, height of 8 mm, line width of 2 mm was printed on the surface of the one-piece golf ball body with the pad stamp using the ink composition for the mark shown in Table 4. Then, the paint composition prepared according to the following method was sprayed with the air-gun and dried at 40° C. to form the clear paint film having a thickness of 10 μm and the mark on the surface of the golf ball body. The one-piece golf ball thus obtained was each evaluated in terms of the coloring-resistance, the adhesion and the repulsion. The results were also shown in Tables 1 to 3.

TABLE 1

| | Golf ball No. | | | | | |
|---|---|---|---|---|---|---|
| | 1 | 2 | 3 | 4 | 5 | 6 |
| Golf ball body composition | — | — | — | — | — | — |
| BR11 | 100 | 100 | 100 | 100 | 100 | 100 |
| Zinc oxide | 23.5 | 23.5 | 23.5 | 23.5 | 23.5 | 23.5 |
| Methacrylic acid | 24 | 24 | 24 | 24 | 24 | 24 |
| Dicumyl peroxide | 0.6 | 0.6 | 0.6 | 0.6 | 0.6 | 0.6 |
| Titanium oxide | 1 | 1 | 1 | 1 | 1 | 1 |
| Blue pigment | 0.05 | 0.05 | 0.05 | 0.05 | 0.05 | 0.05 |
| Phosphorus stabilizer | 0 | 0.03 | 0.06 | 0.8 | 8 | 12 |
| Paint film composition | — | — | — | — | — | — |
| Urethane resin | 100 | 100 | 100 | 100 | 100 | 100 |
| Phosphorus stabilizer | 0.4 | 0.4 | 0.4 | 0.4 | 0.4 | 0.4 |
| Light stabilizer | 2 | 2 | 2 | 2 | 2 | 2 |
| UV-absorber | 2 | 2 | 2 | 2 | 2 | 2 |
| Fluorescent brightener | 0.2 | 0.2 | 0.2 | 0.2 | 0.2 | 0.2 |
| Evaluation | — | — | — | — | — | — |
| Coloring resistance | G | G | E | E | E | E |
| Adhesion against Impact | — | — | — | — | — | — |
| Paint film | G | G | E | E | E | P |

TABLE 1-continued

| | Golf ball No. | | | | | |
|---|---|---|---|---|---|---|
| | 1 | 2 | 3 | 4 | 5 | 6 |
| Mark | G | G | E | E | E | P |
| Adhesion against brush washing | — | — | — | — | — | — |
| Paint film | G | G | E | E | E | P |
| Mark | G | G | E | E | E | P |
| ATTI compression | 96 | 96 | 96 | 96 | 96 | 96 |
| Repuslion coeffcient | 0.703 | 0.705 | 0.707 | 0.710 | 0.713 | 0.715 |

Composition: parts by mass

Golf ball Nos. 1 to 6 are the cases that the golf ball body contains the phosphorus stabilizer in an amount of 0 to 12 parts by mass with respect to 100 parts by mass of the rubber component. This result indicated that the repulsion and the coloring-resistance of the golf ball were getting improved as the amount of the phosphorus stabilizer contained in the golf ball body was increased. Also, it was apparent that all the properties of the coloring-resistance, the repulsion and the adhesion of the paint film and the mark were excellent in the case of golf balls Nos. 3 to 5 which satisfy the requirement that the amount of the phosphorus stabilizer falls within the range from 0.05 to 10 parts by mass with respect to 100 parts by mass of the rubber component.

On the other hand, golf ball No. 6 is the case that the amount of the phosphorus stabilizer contained in the golf ball body was 12 parts by mass with respect to 100 parts by mass of the rubber component. The adhesion to the paint film was lowered, due to the excess amount of the phosphorus stabilizer, although the coloring-resistance and the repulsion of the golf ball were improved.

TABLE 2

| | Golf ball No. | | | | | |
|---|---|---|---|---|---|---|
| | 7 | 8 | 9 | 10 | 11 | 12 |
| Golf ball body composition | — | — | — | — | — | — |
| BR11 | 100 | 100 | 100 | 100 | 100 | 100 |
| Zinc oxide | 23.5 | 23.5 | 23.5 | 23.5 | 23.5 | 23.5 |
| Methacrylic acid | 24 | 24 | 24 | 24 | 24 | 24 |
| Dicumyl peroxide | 0.6 | 0.6 | 0.6 | 0.6 | 0.6 | 0.6 |
| Titanium oxide | 1 | 1 | 1 | 1 | 1 | 1 |
| Blue pigment | 0.05 | 0.05 | 0.05 | 0.05 | 0.05 | 0.05 |
| Phosphorus stabilizer | 0.06 | 0.8 | 8 | 0.06 | 0.8 | 8 |
| Paint film composition | — | — | — | — | — | — |
| Urethane resin | 100 | 100 | 100 | 100 | 100 | 100 |
| Phosphorus stabilizer | 0.06 | 0.06 | 0.06 | 4.5 | 4.5 | 4.5 |
| Light stabilizer | 2 | 2 | 2 | 2 | 2 | 2 |
| UV-absorber | 2 | 2 | 2 | 2 | 2 | 2 |
| Fluorescent brightener | 0.2 | 0.2 | 0.2 | 0.2 | 0.2 | 0.2 |
| Evaluation | — | — | — | — | — | — |
| Coloring resistance | E | E | E | E | E | E |
| Adhesion against Impact | — | — | — | — | — | — |
| Paint film | G | G | G | E | E | E |
| Mark | G | E | E | E | E | E |
| Adhesion against brush washing | — | — | — | — | — | — |
| Paint film | G | G | G | E | E | E |
| Mark | G | G | G | E | E | E |
| ATTI compression | 95 | 97 | 97 | 95 | 96 | 97 |
| Repuslion coeffcient | 0.704 | 0.711 | 0.715 | 0.705 | 0.709 | 0.714 |

Composition: parts by mass

Golf ball Nos. 7 to 12 are the cases that the golf ball body contains the phosphorus stabilizer in an amount of 0.06 to 8 parts by mass with respect to 100 parts by mass of the rubber component and the paint film covering the golf ball body contains the phosphorus stabilizer in an mount of 0.06 to 4.5 parts by mass with respect to 100 parts by mass of the urethane resin component. This result indicated that the golf ball Nos. 7 to 12 were excellent in all the properties of the coloring-resistance, the repulsion of the golf ball body and the adhesion of the paint film and the mark. Especially, the adhesion of the paint film against the shot and the washing were further improved by formulating the phosphorus stabilizer in an amount of not less than about 4 parts by mass in the paint film.

TABLE 3

| | Golf ball No. | | | | | |
|---|---|---|---|---|---|---|
| | 13 | 14 | 15 | 16 | 17 | 18 |
| Golf ball body composition | — | — | — | — | — | — |
| BR11 | 100 | 100 | 100 | 100 | 100 | 100 |
| Zinc oxide | 23.5 | 23.5 | 23.5 | 23.5 | 23.5 | 23.5 |
| Methacrylic acid | 24 | 24 | 24 | 24 | 24 | 24 |
| Dicumyl peroxide | 0.6 | 0.6 | 0.6 | 0.6 | 0.6 | 0.6 |
| Titanium oxide | 1 | 1 | 1 | 1 | 1 | 1 |
| Blue pigment | 0.05 | 0.05 | 0.05 | 0.05 | 0.05 | 0.05 |
| Phosphorus stabilizer | 0 | 0.8 | 12 | 0 | 0.03 | 12 |
| Paint film composition | — | — | — | — | — | — |
| Urethane resin | 100 | 100 | 100 | 100 | 100 | 100 |
| Phosphorus stabilizer | 0.0 | 0.0 | 0.0 | 7.0 | 7.0 | 7.0 |
| Light stabilizer | 2 | 2 | 2 | 2 | 2 | 2 |
| UV-absorber | 2 | 2 | 2 | 2 | 2 | 2 |
| Fluorescent brightener | 0.2 | 0.2 | 0.2 | 0.2 | 0.2 | 0.2 |
| Evaluation | — | — | — | — | — | — |
| Coloring resistance | P | E | G | G | G | E |
| Adhesion against Impact | — | — | — | — | — | — |
| Paint film | P | G | P | P | P | P |
| Mark | F | G | P | P | P | P |
| Adhesion against brush washing | — | — | — | — | — | — |
| Paint film | P | G | P | P | P | P |
| Mark | F | G | P | P | P | P |
| ATTI compression | 96 | 96 | 95 | 95 | 95 | 95 |
| Repuslion coeffcient | 0.703 | 0.710 | 0.714 | 0.701 | 0.702 | 0.713 |

Composition: parts by mass

Golf ball No. 13 is the case that neither the golf ball body nor the paint film contains the phosphorus stabilizer. The repulsion of the golf ball was low and the coloring-resistance and the adhesion of the paint film were also poor. Golf ball No. 14 is the case that the phosphorus stabilizer was contained in the golf ball body in an amount of 0.8 parts by mass with respect to 100 parts by mass of the rubber component. The repulsion and the coloring-resistance of the golf ball, and the adhesion of the paint film and the mark were all excellent. In golf ball No. 15, the adhesion of the paint film and the mark was remarkably lowered, because the golf ball body contained the phosphorus stabilizer in an excessive amount as large as 12 parts by mass. Golf ball Nos. 16 to 18 are the case that the paint film contained 7 parts by mass of the phosphorus stabilizer, and the adhesion of the paint film and the mark tended to be lowered.

TABLE 4

| Ink composition for mark | Parts by mass |
|---|---|
| Nitrocellulose type resin | 16.8 |
| Polyester polyol | 4.2 |

TABLE 4-continued

| Ink composition for mark | Parts by mass |
|---|---|
| Pigment (carbon black) | 9 |
| Flatting agent | 14 |
| Solvent | 49 |
| Curing agent: hexametylene diisocyanate | 7 |

According to the present invention, the repulsion and the coloring-resistance of the one-piece golf ball 5 is improved and the adhesion of the paint film is concurrently improved.

This application is based on Japanese Patent application No. 2003-146493 filed on May 23, 2003, the contents of which are hereby incorporated by reference.

What is claimed is:

1. A one-piece golf ball comprising a golf ball body formed by vulcanizing a rubber composition and a paint film covering the golf ball body, wherein the rubber composition contains 0.05 to 10 parts by mass of a phosphorus stabilizer with respect to 100 parts by mass of the rubber component.

2. The one-piece golf ball according to claim 1, wherein the paint film contains 0.05 to 5 parts by mass of the phosphorus stabilizer with respect to 100 parts by mass of a resin component.

3. The one-piece golf ball according to claim 1, wherein the phosphorus stabilizer is a phosphorous acid compound, a hypophosphorous acid compound, or a derivative thereof.

4. The golf ball according to claim 1, wherein the phosphorus stabilizer is at least one selected from the group consisting of tris (alkylphenyl) phosphate, tris (alkyl) phosphite, and pentaerythritolphosphite derivative.

5. The golf ball according to claim 1, wherein the phosphorus stabilizer is at least one selected from the group consisting of tetrakis (2,4-di-tert-butylphenyl)[1,1-biphenyl]-4,4'-diylbisphosphonite, tetrakis (2,4-di-tert-butyl-5-methylphenyl)[1,1-biphenyl]-4, 4'-diylbisphosphonite, tris (2,4-di-tert-butylphenyl) phosphate, di (stearyl) pentaerythritol diphosphite, di (2,4-di-tert-butylphenyl) pentaerythritol diphosphite, di (2,6-di-tert-butyl-4-methylphenyl)pentaerythritol diphosphite, and 2,2'-methylenebis(4,6-di-tert-butylphenyl)octylphosphite.

6. The one-piece golf ball according to claim 2, wherein the phosphorus stabilizer is a phosphorous acid compound, a hypophosphorous acid compound, or a derivative thereof.

7. The golf ball according to claim 2, wherein the phosphorus stabilizer is at least one selected from the group consisting of tris (alkylphenyl) phosphite, tris (alkyl) phosphite, and pentaerythritolphosphite derivative.

8. The golf ball according to claim 2, wherein the phosphorus stabilizer is at least one selected from the group consisting of tetrakis (2,4-di-tert-butylphenyl)[1,1-biphenyl]-4,4'-diylbisphosphonite, tetrakis (2,4-di-tert-butyl-5-methylphenyl)[1,1-biphenyl]-4, 4'-diylbisphosphonite, tris (2,4-di-tert-butylphenyl) phosphate, di (stearyl) pentaerythritol diphosphite, di (2,4-di-tert-butylphenyl) pentaerythritol diphosphite, di (2,6-di-tert-butyl-4-methylphenyl)pentaerythritol diphosphite, and 2,2'-methylenebis(4,6-di-tert-butylphenyl)octylphosphite.

9. The golf ball according to claim 2, wherein the resin component contained in the paint film is an urethane resin.

10. The golf ball according to claim 9, wherein the urethane resin is a two-component curing type urethane resin obtainable by curing a urethane polyol with a polyisocyanate.

* * * * *